US012680534B2

(12) United States Patent
Marini et al.

(10) Patent No.: US 12,680,534 B2
(45) Date of Patent: Jul. 14, 2026

(54) VALVELESS, MECHANICAL, PRESSURE REGULATING PUMP

(71) Applicant: DANA ITALIA S.R.L., Arco (IT)

(72) Inventors: Michelangelo Marini, Trento (IT); Pier Paolo Rinaldi, Arco (IT); Matteo Stefani, Reggio Emilia (IT)

(73) Assignee: DANA ITALIA S.R.L., Arco (IT)

( * ) Notice: Subject to any disclaimer, the term of this patent is extended or adjusted under 35 U.S.C. 154(b) by 121 days.

(21) Appl. No.: 18/439,527

(22) Filed: Feb. 12, 2024

(65) Prior Publication Data

US 2025/0257723 A1 Aug. 14, 2025

(51) Int. Cl.

| | |
|---|---|
| ***F04B 7/04*** | (2006.01) |
| ***F04B 9/04*** | (2006.01) |
| ***F04B 9/06*** | (2006.01) |

(52) U.S. Cl.

CPC ..... *F04B 7/04* (2013.01); *F04B 9/042* (2013.01); *F04B 9/06* (2013.01)

(58) Field of Classification Search

CPC ..... F04B 7/04–045; F04B 7/008; F04B 9/04–045; F04B 49/12

USPC ..... 417/212–214, 460–461, 466–469, 490, 417/493, 497–498, 289

See application file for complete search history.

(56) References Cited

U.S. PATENT DOCUMENTS

| | | | | | |
|---|---|---|---|---|---|
| 732,169 | A * | 6/1903 | Chapman | F04B 7/04 | 123/495 |
| 2,041,422 | A * | 5/1936 | Orange | F02M 59/02 | 417/501 |
| 3,006,535 | A * | 10/1961 | White | F02M 37/14 | 417/301 |
| 3,063,930 | A * | 11/1962 | De Pava | F04B 7/06 | 417/490 |

(Continued)

FOREIGN PATENT DOCUMENTS

| | | | | |
|---|---|---|---|---|
| DE | 2651476 A | * | 5/1978 | |
| DE | 4336673 A1 | * | 5/1995 | F04B 1/0404 |

(Continued)

OTHER PUBLICATIONS

Marini, M. et al., "Compact Volumetric Pump," U.S. Appl. No. 18/158,074, filed Jan. 23, 2023, 20 pages.

*Primary Examiner* — Alexander B Comley
(74) *Attorney, Agent, or Firm* — McCoy Russell LLP

(57) ABSTRACT

Systems and methods are disclosed for a valveless, mechanical, pressure regulating pump for use in transmissions and other mechanical systems. The pressure regulating pump may include a casing; a pump body having an outer cylindrical portion and an inner cylindrical portion, wherein the outer cylindrical portion includes one or more inlet ports and the inner cylindrical portion includes one or more outlet ports; a piston interposed between the outer cylindrical portion and the inner cylindrical portion and configured to move axially, the piston and the inner cylindrical portion (Continued)

defining a chamber; a first spring at least partially interposed between the piston and the inner cylindrical portion; and a second spring interposed between the casing and the pump body, wherein the pump body is configured to move axially relative to the casing and compress the second spring when a pressure in the chamber exceeds a pre-load of the second spring.

20 Claims, 9 Drawing Sheets

(56) References Cited

U.S. PATENT DOCUMENTS 3,200,591 A * 8/1965 Ray ..... F15B 9/03 251/30.01
3,260,211 A * 7/1966 Springer ..... F02M 43/02 92/60
3,417,702 A * 12/1968 Behm ..... F04B 1/02 92/130 C
3,524,715 A * 8/1970 Grantham ..... F04B 53/14 417/490
3,788,780 A * 1/1974 Chomczyk ..... F04B 7/04 417/493
3,938,425 A * 2/1976 Kroffke ..... F04B 9/107 417/498
RE28,880 E * 6/1976 Farrow ..... B41F 9/00 91/422
4,231,716 A * 11/1980 Kubota ..... F04B 7/06 417/500
5,067,881 A * 11/1991 Maehara ..... B60T 8/4031 417/498
5,102,310 A * 4/1992 Gander ..... F04B 7/06 417/63
5,201,297 A * 4/1993 Eblen ..... F02D 1/183 123/502
5,542,827 A * 8/1996 Dombek ..... F04B 3/003 92/52
5,645,406 A * 7/1997 Rowe ..... F04B 1/0404 475/59
6,162,030 A * 12/2000 Pierrat ..... F04B 1/07 417/466
6,474,963 B1 * 11/2002 Wetzel ..... B60T 8/4031 417/470
6,514,055 B1 * 2/2003 Schuller ..... F04B 19/022 417/469
6,514,056 B1 * 2/2003 Schuller ..... F04B 1/0452 417/551
7,261,088 B2 * 8/2007 Ciampolini ..... F02M 59/107 417/393
7,699,738 B2 * 4/2010 Oomura ..... F04C 2/086 184/29
8,783,418 B2 * 7/2014 Orlitzky ..... F16N 13/02 184/37
10,502,366 B2 * 12/2019 Lee ..... F16N 7/385
2005/0123413 A1 * 6/2005 Winter ..... F04B 7/04 417/521
2019/0176786 A1 * 6/2019 Norberg ..... F04B 49/035
2024/0247647 A1 * 7/2024 Marini ..... F04B 53/162

FOREIGN PATENT DOCUMENTS

DE 10128431 A1 * 12/2002 ..... F04B 1/0413
EP 0682756 B1 * 1/1997 ..... F04B 1/0404
EP 0752061 B1 * 1/1999 ..... F02M 59/34
GB 140982 A * 4/1920 ..... F04B 7/04
GB 505823 A * 5/1939 ..... F04B 9/045
GB 533961 A * 2/1941 ..... F04B 7/04
GB 1310946 A * 3/1973 ..... F04B 53/126
GB 1464146 A * 2/1977 ..... F04B 43/02
WO WO-2010046952 A1 * 4/2010 ..... F04B 1/02
WO WO-2010046953 A1 * 4/2010 ..... F04B 7/04

* cited by examiner

VALVELESS, MECHANICAL, PRESSURE REGULATING PUMP

TECHNICAL FIELD

The present description relates generally to systems and methods for a valveless, mechanical, pressure regulating pump for use in transmissions and other mechanical systems.

BACKGROUND AND SUMMARY

Dry-sump transmission lubrication targets lubrication toward transmission elements and avoids inefficient splashing of oil as in other lubrication methods by using a scavenge pump and a displacement pump. The scavenge pump lifts fluid from the sump to a calm reservoir and the displacement pump feeds a calibrated amount of oil from the calm reservoir to transmission elements. To meet the functional demands of a dry-sump transmission, the scavenge pump may be self-priming, large enough to dry the sump, and able to transfer a two-phase flow.

The inventors herein have identified problems with existing scavenge pumps for dry-sump transmission lubrication. With electric pumps, risk of leakage is increased. For example, if an electric pump is inside a transmission, electric cables need to pass through a housing of the transmission such that the electric pump may be electrically coupled. In another example, if an electric pump is outside the transmission, a mechanical and/or hydraulic connection must pass through the housing. Parts passing through the housing may lead to additional potential degradation points in sealing, therefore increasing chance of leaks. Mechanically driven pumps (e.g., cam actuated) may be entirely within the housing to prevent leakage due to parts passing through the housing, but mechanically driven pumps are subject to excessive pressure chamber build-up, unless check valves are incorporated to prevent pressure exceeding a threshold. Valves may add complexity to a pump, which increases resource demand of manufacturing and potential degradation points.

Thus, embodiments are disclosed herein that solve at least some of the issues described above with a valveless, mechanical, pressure regulating pump. In one embodiment, the pressure regulating pump may include a casing; a pump body accommodated within the casing, the pump body comprising an outer cylindrical portion and an inner cylindrical portion, wherein the outer cylindrical portion includes one or more inlet ports and the inner cylindrical portion includes one or more outlet ports; a piston interposed between the outer cylindrical portion and the inner cylindrical portion and configured to move axially relative to the one or more inlet ports, the piston and a top of the inner cylindrical portion defining a chamber; a first spring at least partially interposed between the piston and the inner cylindrical portion; and a second spring interposed between the casing and a bottom of the pump body, wherein the pump body is configured to move axially relative to the casing and compress the second spring when a pressure in the chamber exceeds a pre-load of the second spring. In this way, when the pressure in the chamber exceeds the pre-load of the second spring, the pump body may move downwards to adjust a vertical position of the inlet ports, thereby decreasing flow rate and ultimately decreasing the pressure in the chamber to ensure operation within a pressure range at or below a threshold pressure.

By removing demand for valves to regulate pressure of the pressure regulating pump, the pressure regulating pump may incorporate fewer parts, thereby decreasing design complexity. The pressure regulating pump may be mechanically driven by a cam, for example, and reversibility of cam rotation may further increase versatility for varying configurations in applications of the pressure regulating pump. In this way, the pressure regulating pump may fit within a variety of systems without parts such as electrical cables extending through a housing of the systems. The pressure regulating pump described herein meets several demands of a scavenge pump for dry-sump transmission lubrication including that the scavenge pump be self-priming, have adequate displacement, and accommodate two-phase flow, while solving at least some of issues described above with current scavenge pumps. Thus, the pressure regulating pump may be used within a transmission, and may also be used in other mechanical systems wherein suction of a fluid, such as oil, may be desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1B:
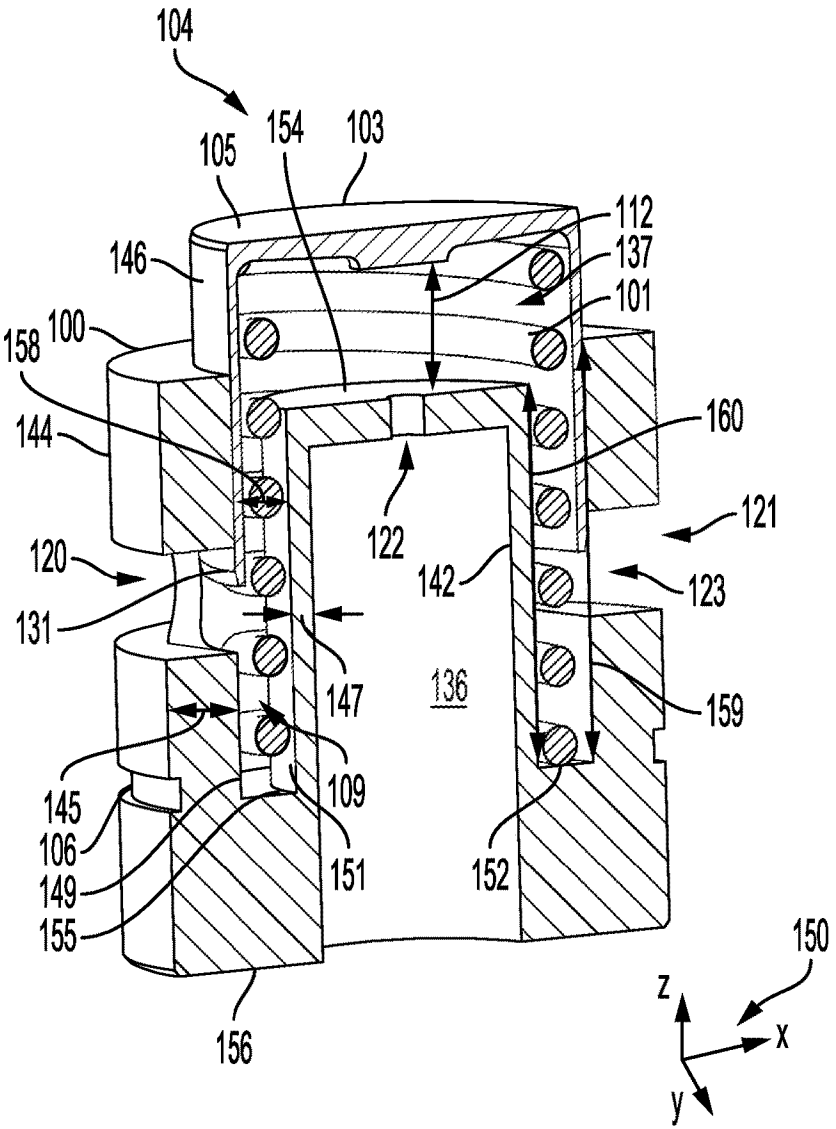
FIG. 1B shows a cross section view of the body and piston of FIG. 1A.
Figure 1A:
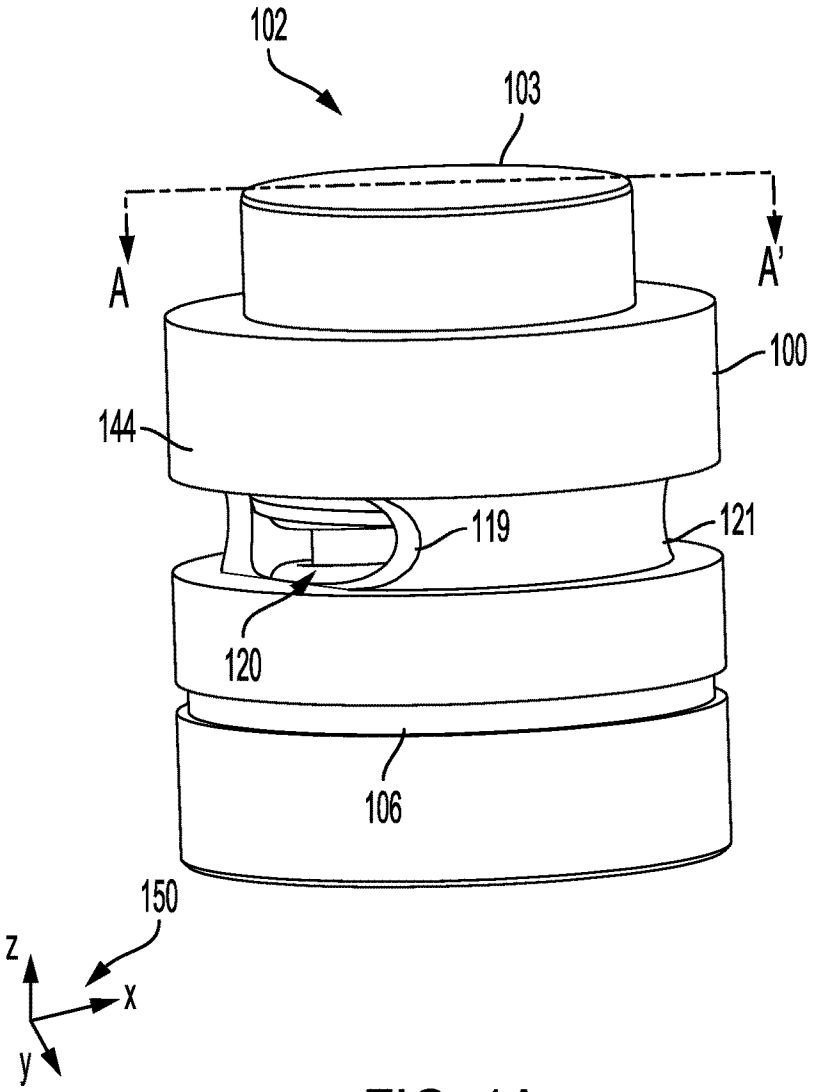
FIG. 1A shows a body and piston of a pressure regulating pump according to an embodiment of the present disclosure.
Figure 2:
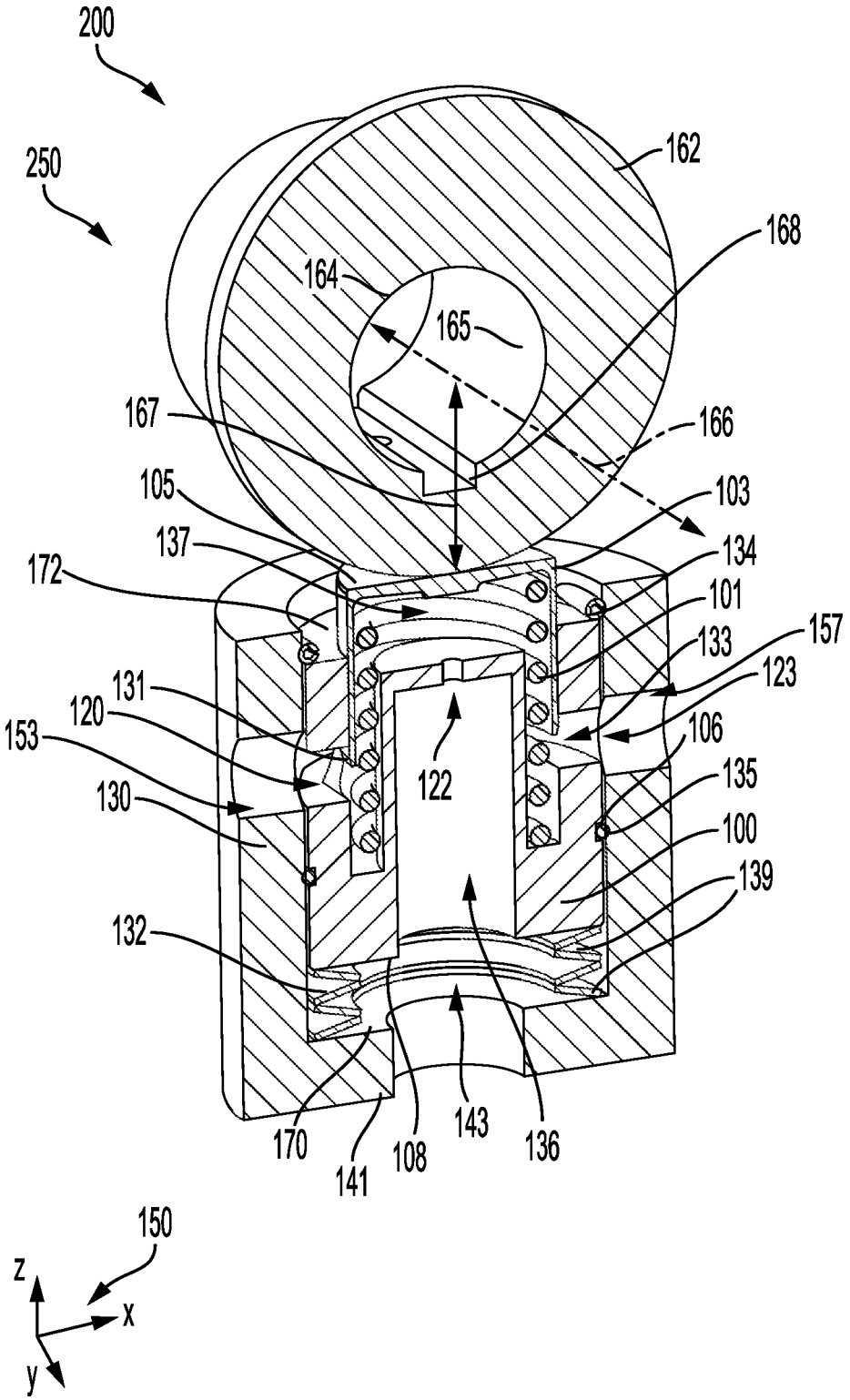
FIG. 2 shows the pressure regulating pump in a top dead center (TDC) position.
Figure 3:
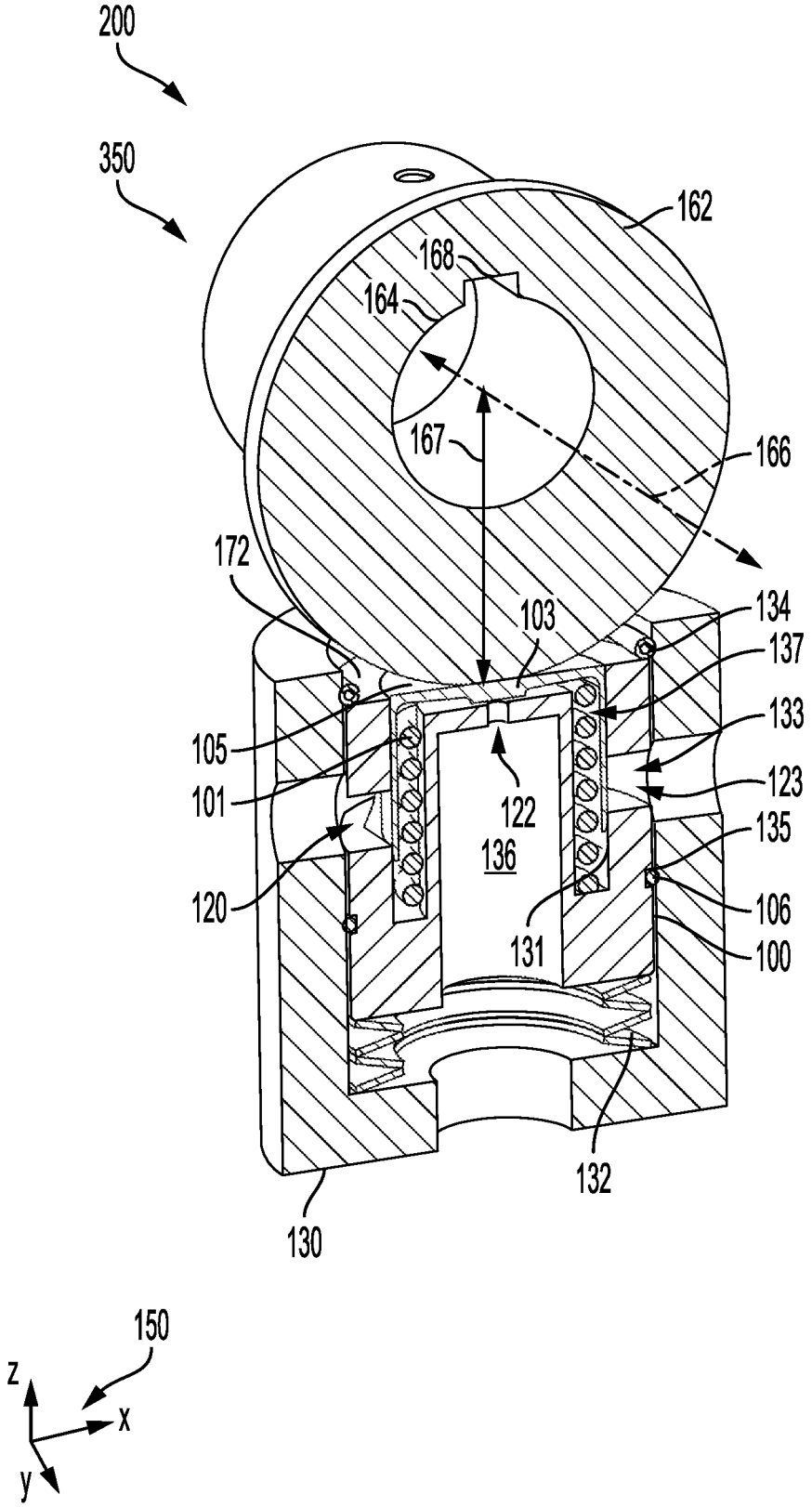
FIG. 3 shows the pressure regulating pump in a bottom dead center (BDC) position.
Figure 5:
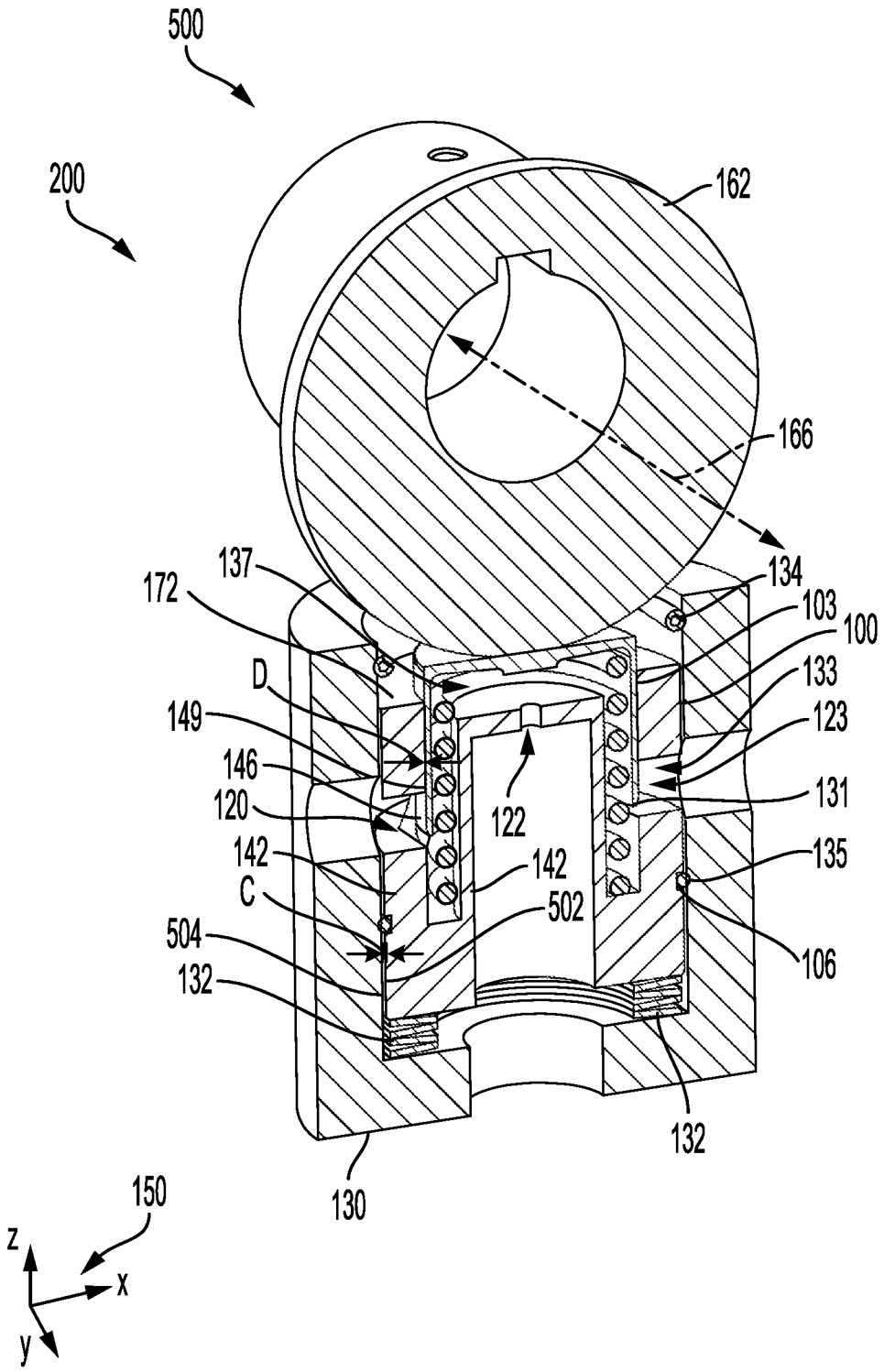
FIG. 5 shows the pressure regulating pump in a pressure regulating position.
Figure 6B:
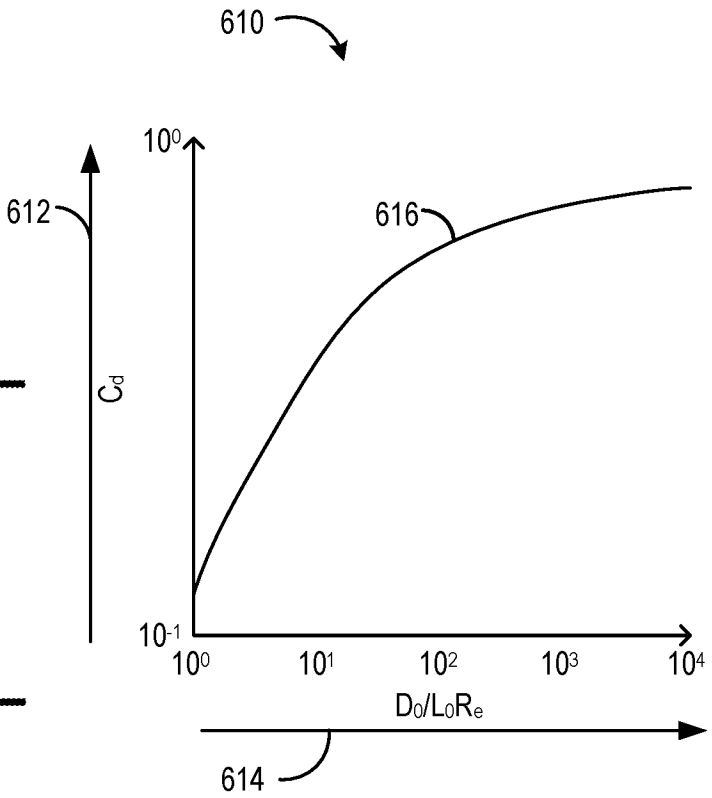
FIG. 6B shows a graph of a flow coefficient for an orifice, such as the orifice in FIG. 6A.
Figure 6A:
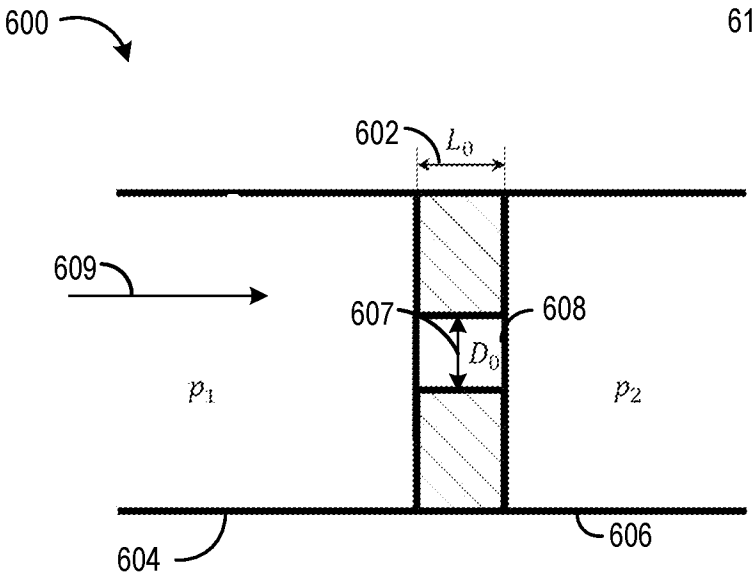
FIG. 6A shows a view of an orifice, such as an outlet port of the pressure regulating pump.
Figure 7:
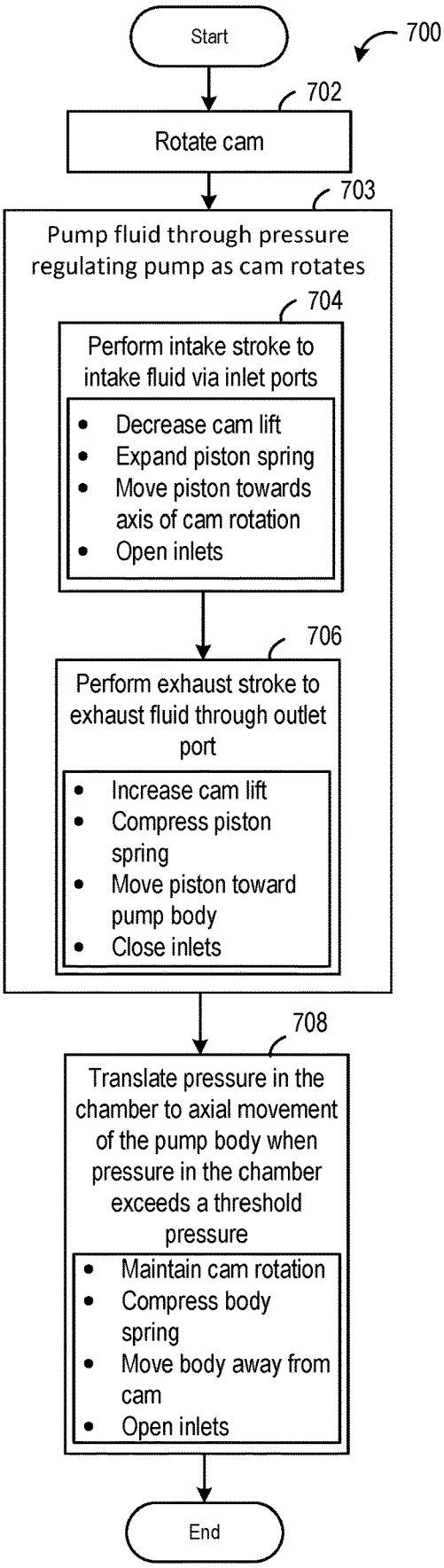
FIG. 7 shows a flowchart of an example method of operating a pressure regulating pump.
Figure 8A:
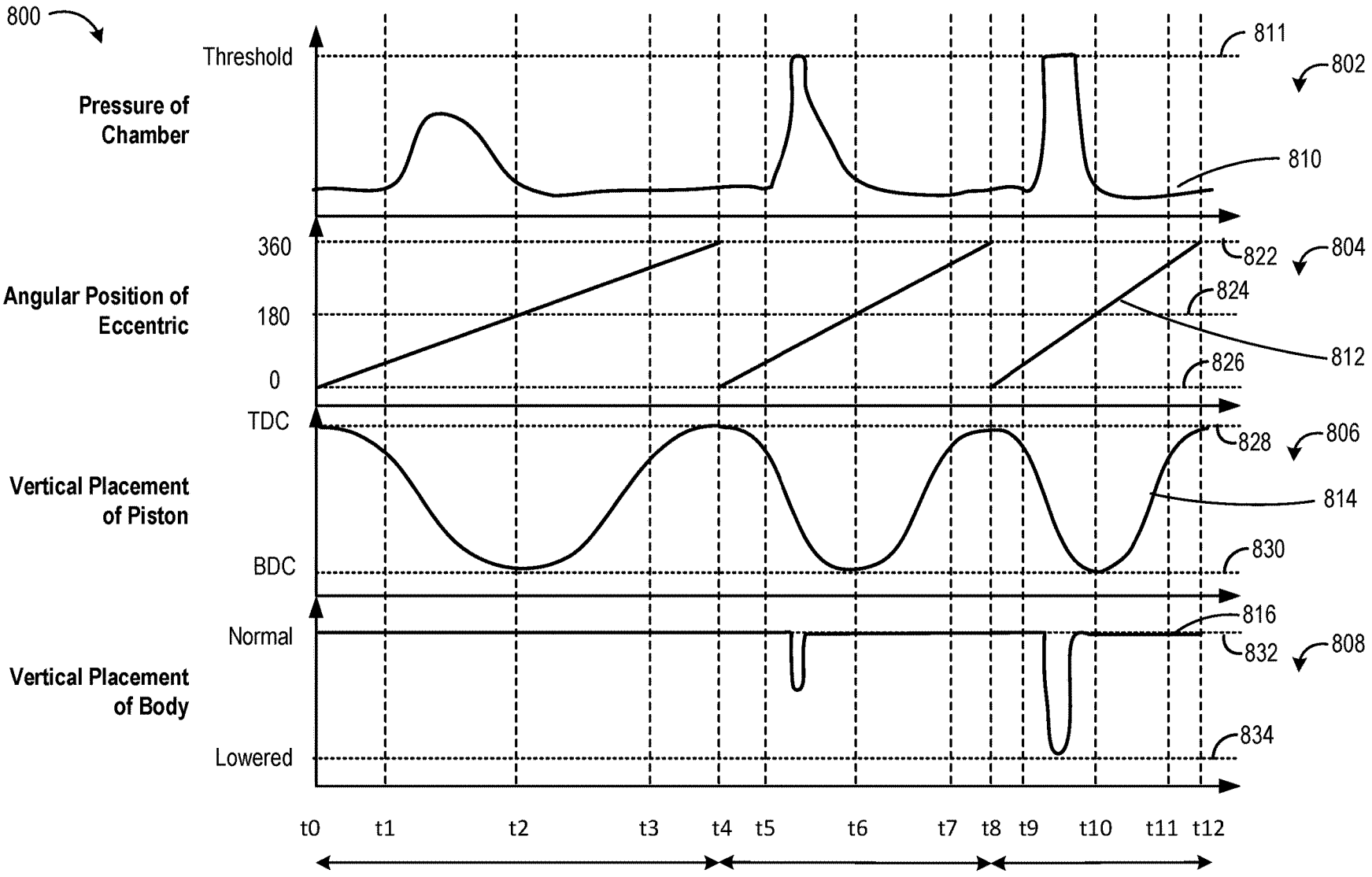
FIGS. 8A and 8B show an example timeline diagram of operation of a pressure regulating pump over a first period of time and a second period of time, respectively.
Figure 8B:
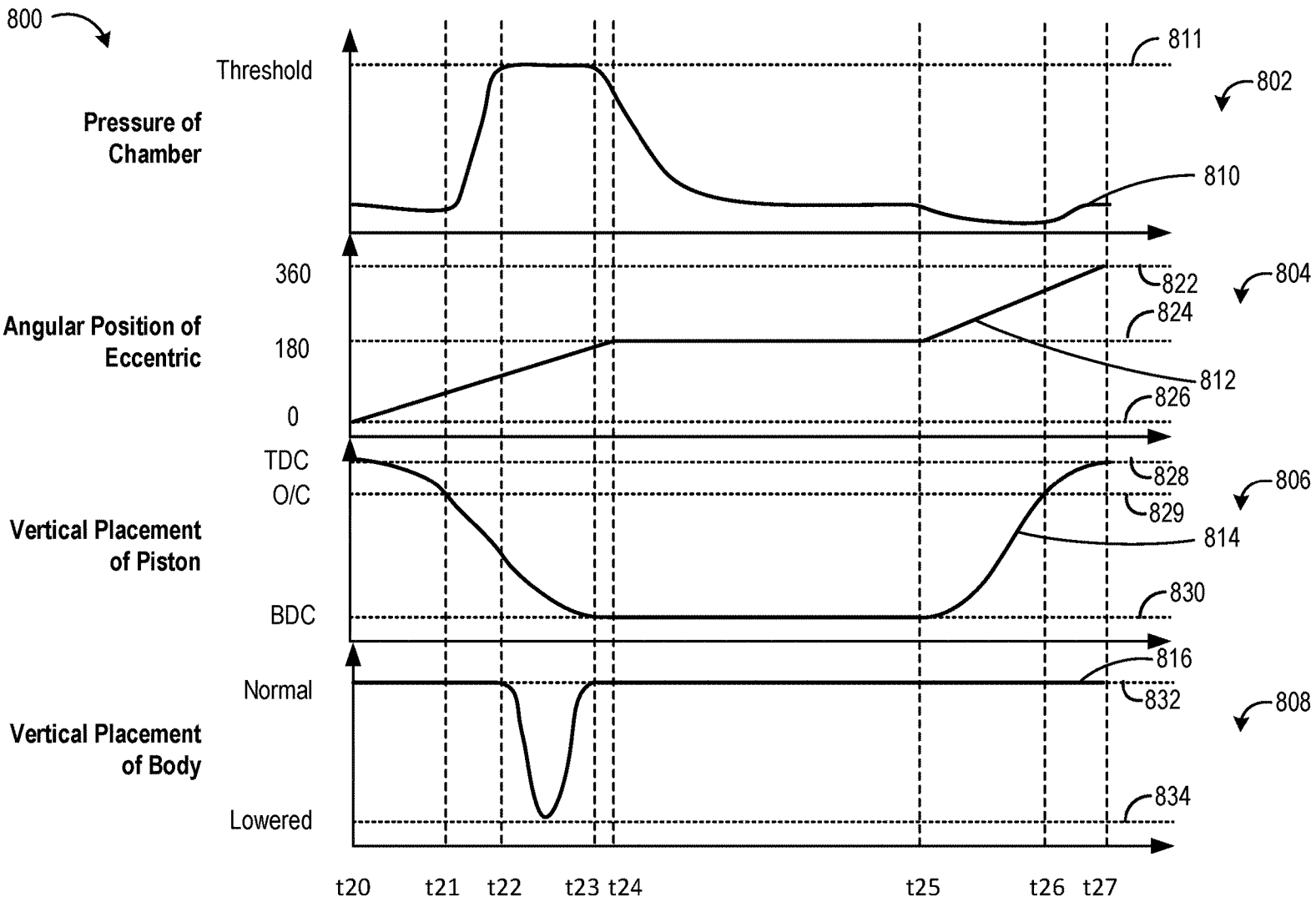

The present disclosure relates to systems and methods for a pressure regulating pump. The pressure regulating pump may include a body and a piston wherein the piston may move axially relative to the body in order to pump fluid through the pressure regulating pump. An example of the body and the piston are depicted in FIGS. 1A and 1B, along with a first spring which guides movement of the piston. The body and the piston are further shown in FIG. 2, which also includes a cam which causes movement of the piston, as well as a casing and a second spring which may provide pressure regulation during pumping of fluid through the pressure regulating pump. FIG. 2 specifically shows a top dead center (TDC) position of the pressure regulating pump, and FIG. 3 shows a bottom dead center (BDC) position of the pressure regulating pump. FIG. 4A shows the pressure regulating pump during an exhaust stroke in which fluid is pushed out of the pump through one or more outlet ports during transition from the TDC position of FIG. 2 to the BDC position of FIG. 3. Conversely, fluid may enter the pressure regulating pump through one or more inlet ports during an intake stroke as described in reference to FIG. 4B. The pressure regulating pump may be positioned in a mechanical system such that fluid enters the pump from a first portion of the mechanical system which is fluidly coupled to the inlet ports, and exits the pump to a second portion of the mechanical system which is fluidly coupled to the outlet ports. As a non-limiting example, the mechanical system may be a transmission, where the first portion is a sump, and the second portion is a calm reservoir. During the exhaust stroke, pressure in a chamber of the pressure regulating pump may increase beyond a desired pressure range, such as below a threshold. Specifically, a pressure differential across the one or more outlet ports, such as the orifice shown in FIG. 6A, may increase due to the relationships between fluid properties, flow rate, and orifice geometry as shown in a graph in FIG. 6B of a discharge coefficient across the orifice. Thus, the pressure regulating pump may be adapted to maintain a pressure of the chamber of the pump at or below a threshold pressure by vertical movement of the pump body and hence the inlet ports, as shown in a pressure regulating position as shown in FIG. 5 in order. A method by which a pressure regulating pump, such as the pressure regulating pump of FIGS. 2-5, may operate is shown in FIG. 7, including performing an intake stroke, an exhaust stroke, and regulating pressure. FIGS. 8A and 8B show timeline diagrams of events of interest during operation of the pressure regulating pump.

A pressure regulating pump may include a body, an example of which is shown in FIGS. 1A and 1B. Specifically, FIG. 1A shows a first view 102 of a body 100 which may include a first inlet port 120 positioned on an intake groove 121, and a second groove 106. FIG. 1A further shows a piston 103, which may be cylindrical and configured to be at least partially within the body 100. FIG. 1B shows a cross section view 104 of the body 100 and the piston 103 along section A-A' as shown in FIG. 1A, and FIG. 1B additionally shows a piston spring 101. FIGS. 1A and 1B also show reference axes 150 including an x-axis, y-axis, and z-axis. In one example, the z-axis may be parallel to a direction of gravity such that a negative z-direction may be the same as the direction of gravity. Additionally or alternatively, the z-axis may be a direction of axial movement of the piston 103 relative to the body 100. The reference axes are further shown in FIGS. 1B-5.

The body 100 may include an outer cylindrical portion 144 with intake groove 121 having first inlet port 120 and a second inlet port 123 positioned thereon. The intake groove 121 may be a section of the outer cylindrical portion 144 of the body 100 with a reduced diameter. Consequently, the intake groove 121 may have a smaller thickness than the rest of the outer cylindrical portion 144. The first inlet port 120 and the second inlet port 123 may be arranged opposite one another (e.g., across a diameter of the outer cylindrical portion 144 parallel to the x-axis) along the intake groove 121. The first inlet port 120 and the second inlet port 123 may each be circular in shape, at least in some embodiments. Further, the first inlet port 120 may have a chamfered edge 119 defining an opening of the inlet port 120. For example, the chamfered edge 119 may be curved such that the opening is circular. Due to the chamfered edge 119, the opening may gradually decrease in size (e.g., diameter) along the thickness towards the interior of the body 100 (e.g., in the positive x-direction) of the intake groove 121. The second inlet port 123 may have a similarly shaped chamfered edge (not shown). The curved, chamfered edges (e.g., chamfered edge 119) may allow fluid to flow into the body 100 through the first inlet port 120 and the second inlet port 123 more smoothly than could be achieved with sharp corners (e.g., 90 degree corner edges). In some examples, the first inlet port 120 and the second inlet port 123 may be drilled tangentially with respect to the body 100 such that the first inlet port 120 and the second inlet port 123 are elongated in the y-direction compared to the z-direction. In other embodiments, the first inlet port 120 and the second inlet port 123 may have other shapes, sizes, and or arrangements. For example, in some embodiments, the inlet ports may be elliptical, rectangular, or other shapes according to a desired flow of fluid therethrough. In another example, body 100 may include three or more inlet ports arranged radially around the outer cylindrical portion 144 of body 100 on intake groove 121, or the body 100 may only include one inlet port. The outer cylindrical portion 144 may further include the second groove 106 which may be configured (e.g., sized, shaped) to accept a sealing ring, such as sealing ring 135 shown in FIGS. 2-5.

The body 100 may further include an inner cylindrical portion 142, a hollow center of which may form discharge compartment 136. Inner cylindrical portion 142 may be positioned centrally within a hollow center of outer cylindrical portion 144. Thus, the inner cylindrical portion 142 may be housed within the outer cylindrical portion 144. Further, the body 100 may include a body base 156 of cylindrical shape, and the inner cylindrical portion 142 and outer cylindrical portion 144 may extend axially therefrom. For example, the inner cylindrical portion 142 and outer cylindrical portion 144 may be physically connected via the body base 156. The inner cylindrical portion 142 may extend a smaller height 160 from the base than a height 159 by which the outer cylindrical portion 144 extends from the body base 156. Additionally, the inner cylindrical portion 142 may have a smaller thickness 147 than the thickness 145 of the outer cylindrical portion. An outer cylindrical surface 151 of the inner cylindrical portion 142 may be spaced away from an inner cylindrical surface 149 of the outer cylindrical portion 144 by a distance 158 and a top 154 of the inner cylindrical portion 142 (e.g., a top surface of the inner cylindrical portion 142) may be spaced from the piston 103 by a varying distance 112 with a chamber 137 therebetween. A cylindrical cavity 109 may be formed between the inner cylindrical portion 142 and the outer cylindrical portion 144, and defined by the inner cylindrical surface 149 of the outer cylindrical portion 144, the outer cylindrical surface 151 of the inner cylindrical portion 142, and a top surface 155 of the body base 156. As such, the cylindrical cavity 109 may be in fluid communication with the chamber 137. The inner cylindrical portion 142 may include an outlet port 122 positioned at and extending through the top 154 of the inner cylindrical portion 142. The outlet port 122 may be positioned vertically higher than the first inlet port 120 and second inlet port 123. The outlet port 122 may be an orifice sized to ensure desired fluid flow across the orifice as will be discussed further in regards to FIGS. 6A and 6B. The chamber 137 and discharge compartment 136 may be fluidly coupled via the outlet port 122. For example, fluid, such as oil and/or air, may flow from chamber 137 to the discharge compartment 136 through the outlet port 122 in the negative z-direction. In other examples, the inner cylindrical portion 142 may include more than one outlet port, such as two or more outlet ports.

The piston 103 may be a bucket tappet that is cylindrical in shape with a circular top 105 and a cylindrical wall 146 having a skirt edge 131 at a bottom of the wall 146. In some embodiments, a diameter of the piston 103 may be between 30 and 33 millimeters, inclusively. A cavity of the piston 103 may form part of chamber 137, and the cavity may be configured to accept piston spring 101. Piston spring 101 and the piston 103 may be configured to fit between the outer cylindrical portion 144 and inner cylindrical portion 142 of the body 100 such that outer cylindrical portion 144 may circumferentially surround at least part of the piston 103, the piston 103 may circumferentially surround at least part of piston spring 101, and piston spring 101 may circumferentially surround inner cylindrical portion 142. In some examples, the piston spring 101 may be in face sharing contact with the inner cylindrical portion 142. In other examples, the piston spring 101 may be spaced away from the inner cylindrical portion 142 to reduce friction due to movement of piston spring 101. Further, a first end of the piston spring 101 may be coupled to the piston 103 at a first point of connection (not shown in FIG. 1B), and a second end of the piston spring 101 may be coupled to the body 100 at a second point of connection 152. The first point of connection is on a surface at the top 105. The second point of connection 152 is on the top surface 155 of the body base 156 between the inner cylindrical portion 142 and the outer cylindrical portion 144. When attached at the second point of connection 152, the piston spring 101 may contact the top surface 155 via the second point of connection 152.

In the configuration shown in FIG. 1B, the outer cylindrical portion 144 and inner cylindrical portion 142 may accommodate the piston 103 as the piston 103 moves (e.g., along the z-axis) during compression and expansion of the piston spring 101 and constrain movement of piston 103 along the x-axis and y-axis. In this way, the skirt edge 131 of the piston 103 may be lowered and raised to increase and decrease, respectively, coverage of the first inlet port 120 and the second inlet port 123. For example, the piston spring 101 may be compressed and the piston 103 moved downwards (e.g., in the negative z-direction), such that the skirt edge 131 may be lowered to further cover the first inlet port 120 and the second inlet port 123. Consequently, the volume of chamber 137 may be decreased. In another example, the piston spring 101 may be expanded and the piston 103 moved upwards, such that the skirt edge 131 may be raised to decrease coverage of the first inlet port 120 and the second inlet port 123. Therefore, the volume of chamber 137 may increase. Movement of elements of the pressure regulating pump, including the piston spring 101 and piston 103, are described further below in regards to FIGS. 2-4B.

Turning to FIG. 2, a pressure regulating pump 200 is shown, including the body 100, piston spring 101, and piston 103 of FIGS. 1A-B. Some labels shown in FIGS. 1A-B may not be included in FIG. 2 for clarity. The pressure regulating pump 200 may further include a cam 162, a casing 130, a body spring 132, one or more end stop devices 134, and a sealing ring 135. The casing 130 may be cylindrical in shape and circumferentially surround the body 100 such that the body 100 may be within a hollow interior of the casing 130. Thus, the body 100 may be housed within the casing 130. The casing 130 may include a casing base 141 at the bottom of the body. The casing base 141 may have a cylindrical shape and a hollow interior with an inner diameter that is less than an inner diameter of the hollow interior of the rest of the casing 130. In some examples, the inner diameter of the casing base 141 (e.g., the inner diameter of the hollow interior of the casing base 141) may be substantially the same (e.g., within 5%) as an inner diameter of the inner cylindrical portion of the body 100. In some examples, the casing 130 may be a casting of a transmission in which the pressure regulating pump is employed. The casing 130 may be in a fixed location (e.g., relative to the axis of rotation 166) such that the casing 130 does not move due to movement of other elements of the pressure regulating pump 200.

A space formed by the intake groove 121 of the body 100 and the casing 130 together form a suction annulus 133. The suction annulus 133 may be fluidly connected to a first portion of a mechanical system, for example a transmission sump (not shown), via one or more holes in the casing 130, such as a first hole 153 and a second hole 157, in some examples. The first hole 153 and the second hole 157 may have a suitable shape, including circular, elliptical, or the like. In some examples, the first hole 153 and the second hole 157 may be drilled tangentially in the casing 130 such that their shapes resemble the first inlet port 120 and the second inlet port 123. In other examples, the first hole 153 and the second hole 157 may be machined differently. In some examples, the one or more holes may have different geometry from the inlet ports.

The one or more holes may each align with an inlet port, in some examples. For example, the first hole 153 may align with the first inlet port 120 and the second hole 157 may align with the second inlet port 123 such that center points thereof are aligned along a common axis (e.g., parallel to the x-axis). Further, the one or more holes may each have a cross-sectional area perpendicular to the axis (e.g., in a y-z plane) greater than or equal to a cross-sectional area perpendicular to the axis of the inlet port which the hole aligns with. For example, the first hole 153 may be sized to have an equal or larger cross-sectional area than that of the first inlet port 120, and the second hole 157 may be sized to have an equal or larger cross-sectional area than that of the second inlet port 123.

In other examples, the one or more holes (e.g., the first hole 153 and the second hole 157) may not be aligned with the inlet ports (e.g., the first inlet port 120 and the second inlet port 123). For example, the casing 130 may include more or fewer holes than inlet ports and/or the holes may be offset from the inlet ports. In such an example, a total cross-sectional area of the holes (e.g., a sum of the cross-sectional areas of each hole) may be greater than or equal to a total cross-sectional area of the inlet ports (e.g., a sum of the cross-sectional areas of each inlet port).

A sealing ring 135 (e.g., an O-ring) may be positioned in second groove 106 of the body 100 such that a seal is formed between the casing 130 and body 100 at the sealing ring 135. In this way, fluid in the suction annulus 133 may not be able to flow between the body 100 and casing 130 past the sealing ring 135 (e.g., towards the body spring 132 and discharge compartment 136). In at least some embodiments, the seal formed by sealing ring 135 may be a hermetic seal. The suction annulus 133 may also fluidly couple to the chamber 137 via first inlet port 120 and second inlet port 123, at least in some positions of the piston 103, including a top dead center (TDC) position 250 of pressure regulating pump 200 shown in FIG. 2.

The body spring 132 may be positioned between the body 100 and the casing base 141 of the casing 130 such that the body spring 132 may be above a top surface 170 of the casing base 141 of the casing 130 and the body 100 may be above a top of the body spring 132. Further, a first end of the body spring 132 may be physically coupled to a bottom surface 108 of the body 100 and a second end of the body spring 132 may be physically coupled to the top surface 170 of the casing base 141. The first end of the body spring 132 may be in a relatively positive z-direction compared to the second end of the body spring 132, and compression and/or expansion of the body spring 132 may occur parallel to the z-axis in response to movement of other elements of the pressure regulating pump. In at least some embodiments, the body spring 132 may comprise one or more cup springs in series with each of a plurality of cups 139 aligned axially with one another, forming an opening 143 through the center of the body spring 132 as an extension of the discharge compartment 136 formed by the inner cylindrical portion 142 of the body 100. For example, the body spring 132 may include four cup springs each with an outer diameter of 40 mm, an inner diameter of 14.3 mm, and a thickness of 1.25 mm. In other examples, different dimensions may be used. In other embodiments, the body spring 132 may be a single spring such as a compression, helical, or spiral spring. Further, the body spring 132 may be an elastic body acting as spring, in some examples.

One or more end stop devices 134 may be physically coupled to inner surfaces of the casing 130, such that vertical movement of the body 100 relative to the casing 130 is limited by the one or more end stop devices 134. For example, the body spring 132 may push the body 100 towards the cam 162 until a top 172 of the body 100 contacts the one or more end stop devices 134 and further upwards motion of the body 100 may be prevented. In some embodiments, the one or more end stop devices 134 may be a ring (and thus the one or more end stop devices 134 may include a single stop device). In other embodiments, the one or more end stop devices 134 may include two or more end stop devices, such as two or more segments (e.g., elastic pins) arranged radially around, and in physical contact with, the inner wall of the outer cylindrical portion 144.

The cam 162 may be cylindrical in shape and may include an opening 164 defined by an inner cylindrical surface 165 through which a shaft (not shown) may extend along the y-axis. The cam 162 may further include a notch 168 in the opening 164 (e.g., formed by the inner cylindrical surface 165) wherein a radially protruding portion of the shaft with complementary geometry may lock with the notch 168, allowing for rotation of the shaft to cause substantially (e.g., within 5%) the same angular speed of the cam 162 about a shared axis of rotation 166. In some examples, the shaft may be formed integrally with the cam 162. The opening 164 may be circular and offset from a center (e.g., in an x-z plane cross section) of the cam 162, and the axis of rotation 166 may be fixed in a center of the opening 164. In this way, the cam 162 may rotate asymmetrically such that the cam 162 may extend radially by different distances depending on an angular position of the cam 162. Rotation of the cam 162 may occur in a clockwise or counter clockwise direction around axis of rotation 166 to operate the pressure regulating pump 200, which may allow the pressure regulating pump 200 to be employed in a variety of system configurations, for example within a transmission. Rotation of the cam 162 and the shaft may be driven by a suitable rotating source such as an engine, an electric machine, an input shaft of the transmission, or the like. In other examples, the pressure regulating pump 200 may include a cam-follower and a lever arm.

The cam 162 may be in direct physical contact with the top 105 of piston 103, and the cam 162 may be eccentric such that the cam 162 may change a position (e.g., along the z-axis) of piston 103 relative to the body 100 as the cam 162 is rotated by the shaft. In other words, the piston 103 may be moved axially as a result of radial movement of the cam 162 due to rotation of the cam 162. As such, energy may be transferred to pressure regulating pump 200 via cam 162. The piston spring 101 may be positioned as described with respect to FIGS. 1A-B and may press against piston 103 (e.g., in a positive z-direction) in opposition to the cam 162 pressing against piston 103 (e.g., in a negative z-direction). Thus, the piston 103 may be spring-loaded such that the piston spring 101 may push upwards with the spring force in opposition to the downward force exerted by the cam 162 on the piston 103. Further, upward movement of the piston 103 may occur due to the spring force of the piston spring 101 and downward movement of the piston may occur under force of the cam 162. In FIG. 2, the pressure regulating pump 200 is shown specifically in a TDC position 250, which includes the piston 103 at a topmost position (e.g., most positive z-location) due to a varying distance 167 between the axis of rotation 166 and top 105 of piston 103 (e.g., in a z-direction) being minimized. The skirt edge 131 of piston 103 may be at a topmost position, such that the first inlet port 120 and second inlet port 123 may be covered by the wall 146 of piston 103 less than in at least some other pressure regulating pump positions, such as a bottom dead center position (as described in more detail below). The first inlet port 120 and the second inlet port 123 may be at least partially uncovered in the TDC position. In some examples, the piston 103 may not cover the first inlet port 120 and second inlet port 123 at all in the TDC position because the skirt edge 131 may be at the top of or above the first inlet port 120 and second inlet port 123. In other examples, the piston 103 may partially cover the first inlet and second inlet port 123 in the TDC position. The body spring 132 may be more extended in the TDC position compared to other positions of the pressure regulating pump, such that the body 100 is pushed upwards by the body spring 132 against the one or more end stop devices 134.

The angular position of the cam 162 with minimum cam lift as shown in FIG. 2 and described above will be referenced herein as a "reference angular position," and understood to be a rotation of the cam by 0 degrees. The reference angular position may serve as a comparison in regards to other positions further described below.

FIG. 3 shows the pressure regulating pump 200 of FIG. 2 in a bottom dead center (BDC) position 350. FIG. 3 is labeled similarly and repeated elements will not be introduced, however, some part numbers from FIG. 2 have been excluded from FIG. 3 for clarity. The BDC position 350 may include cam 162 in a position rotated 180 degrees (e.g., clockwise or counter clockwise around axis of rotation 166) compared to the reference angular position, resulting in the varying distance 167 being maximized, piston spring 101 being compressed, and piston 103 being at a bottommost position (e.g., in a negative z-direction). Thus, the piston 103 may be movable between the TDC position 250 and BDC position 350. The body 100 may be in a same position as in the TDC position 250 of FIG. 2 with body spring 132 pushing the body 100 upwards against the one or more end stop devices 134. In some embodiments, the top 105 of the piston 103 may align (e.g., in an x-y plane) with the top 172 of the body 100 in the BDC position. Additionally or alternatively, the piston 103 may remain spaced away from the body 100 in the BDC position 350, but relatively less so than in TDC position 250 as shown in FIG. 2.

Consequently, the first inlet port 120 and second inlet port 123 may be closed by the piston 103 due to the skirt edge 131 of the piston 103 being at the bottom of or below the first inlet port 120 and second inlet port 123. Said another way, the fluidic connection between the suction annulus 133 and the chamber 137 via first inlet port 120 and second inlet port 123 may be blocked by the piston 103 in BDC position 350 of the pressure regulating pump 200.

Figure 4B:
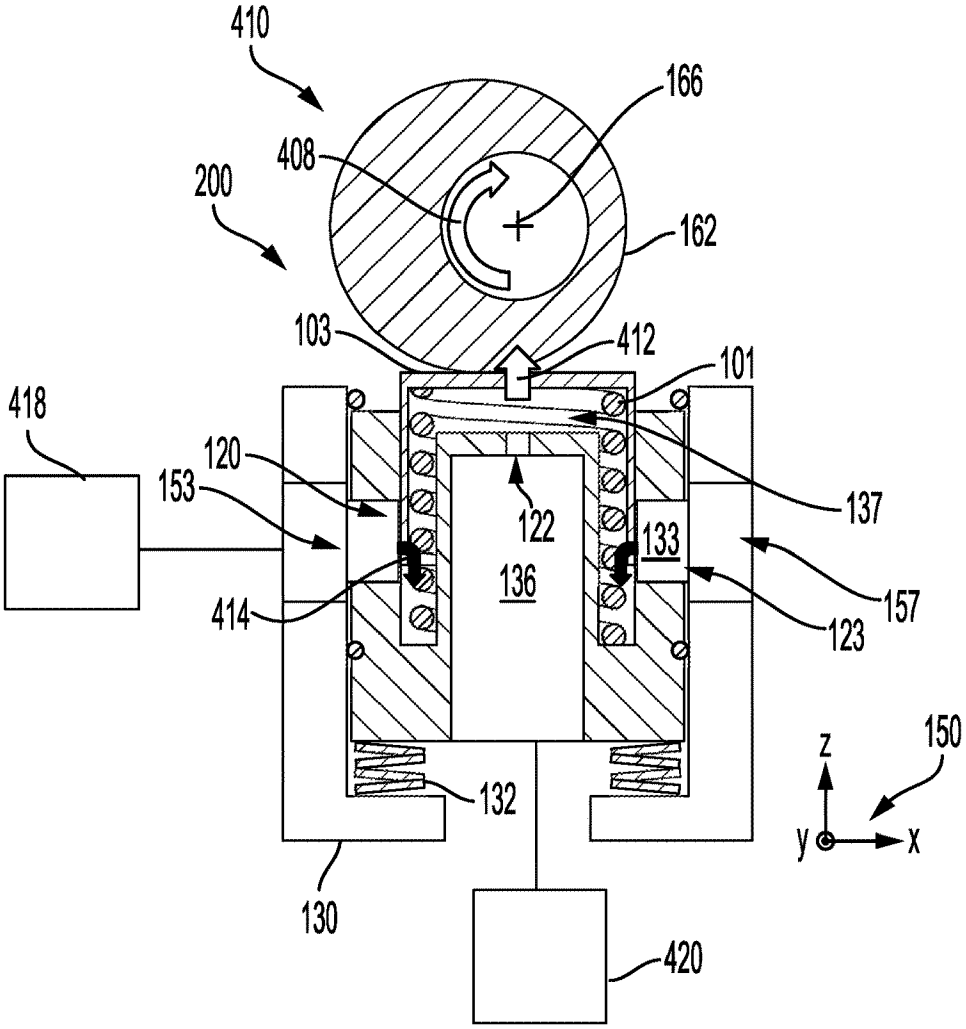
FIG. 4B shows the pressure regulating pump during an intake stroke which includes transitioning from the BDC position shown in FIG. 3 to the TDC position shown in FIG. 2.
Figure 4A:
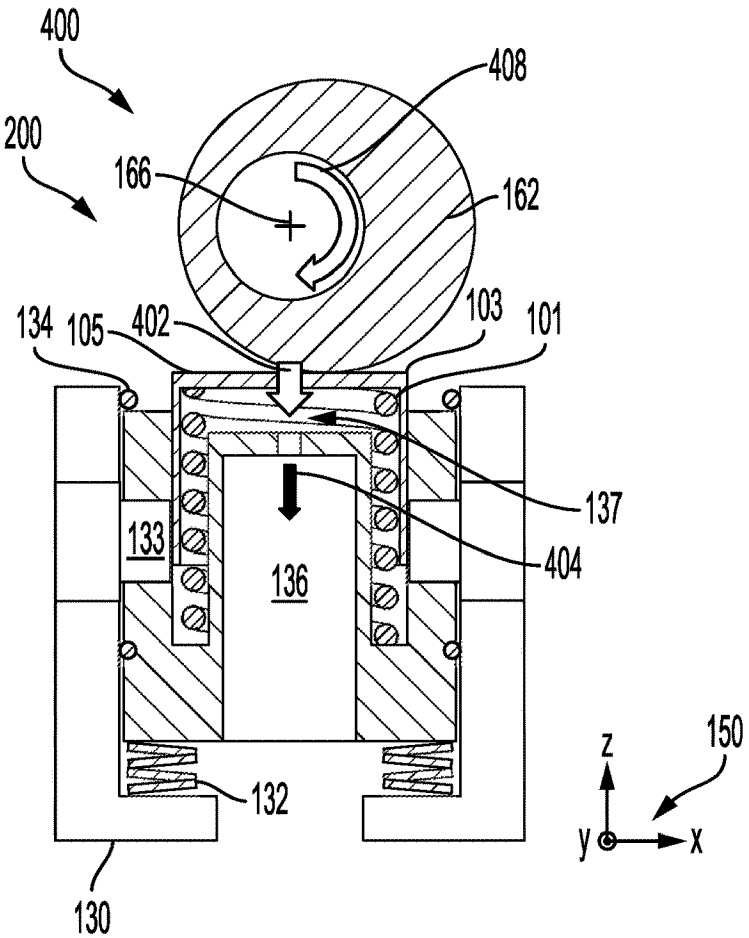
FIG. 4A shows the pressure regulating pump during an exhaust stroke which includes transitioning from the TDC position shown in FIG. 2 to the BDC position shown in FIG. 3.

FIGS. 4A and 4B show an exhaust stroke 400 and an intake stroke 410 of the pressure regulating pump 200. The exhaust stroke 400 may be a transition from TDC position 250 of FIG. 2 to BDC position 350 of FIG. 3, and conversely the intake stroke may be a transition from BDC position 350 of FIG. 3 to TDC position 250 of FIG. 2. In transitioning between the TDC and BDC as described above, the piston 103 may move, the piston spring 101 be compressed and/or expanded, and other elements remain in a same position. For example, the body 100 and casing 130 may not move relative to the axis of rotation 166. Movement of the body 100 may occur in response to pressure exceeding a threshold pressure, as will be described below with reference to FIG. 5. The pressure regulating pump 200 may continue to oscillate between the TDC and BDC positions according to rotation of the cam 162, with the speed at which piston 103 moves being related to the angular speed of cam 162 rotation.

Starting with the exhaust stroke 400, the cam 162 may rotate, for example in a clockwise direction as shown by arrow 408, between the reference angular position and 180 degrees therefrom which may exert a force of the piston 103 in a downward direction indicated by arrow 402. Consequently, the piston may be moved downwards (e.g., in a negative z-direction) such that skirt edge 131 of the piston 103 may move downwards indicated by arrow 404, increasing coverage of the first inlet port 120 and second inlet port 123. As the skirt edge 131 reaches the bottom of the first inlet port 120 and second inlet port 123, the first inlet port 120 and second inlet port 123 fluidly separate the suction annulus 133 from the chamber 137, thereby increasing pressure in the chamber 137. Increasing pressure to the chamber 137 may cause flow of fluid from the chamber 137 to the discharge compartment 136 through the outlet port 122. As such, a first portion of the exhaust stroke, where the first inlet port 120 and/or the second inlet port 123 are not fully closed by the piston 103, may not contribute to flow of fluid towards the discharge compartment 136. In contrast, a second portion of the exhaust stroke where the first inlet port 120 and the second inlet port 123 are fully closed may contribute to flow being delivered by the pressure regulating pump 200, for example to a storage tank or calm reservoir. The first portion is hereby referred to as an inactive portion, and the second portion is hereby referred to as an active portion.

During the intake stroke 410, the piston spring 101 may push piston 103 away from body 100, in a direction indicated by arrow 412, which may generate suction to draw fluid (e.g., lubricant, oil, air) through the suction annulus 133 and into the chamber 137 as the chamber 137 expands in volume. The stiffness of piston spring 101 may be chosen based on mass of piston 103, force exerted on the piston that is due to suction action, and/or a desired acceleration of piston 103, which depends on camshaft velocity and the camshaft profile. As the piston 103 is raised, first inlet port 120 and second inlet port 123 are opened to fluidly couple the suction annulus with chamber 137, allowing fluid to enter the chamber 137 from the suction annulus 133 as indicated by arrows 414. The first inlet port 120 and the second inlet port 123 may be shaped with a greater width (e.g., dimension parallel with the y-axis) than height (e.g., dimension parallel with the z-axis) as described above such that an amount of fluid entering the pressure regulating pump 200 during the intake stroke is maximized without increasing the portion of the intake stroke in which the first inlet port and the second inlet port are not closed by the piston 103.

FIG. 4B further includes a first portion 418 and a second portion 420 of a mechanical system in which the pressure regulating pump 200 may be placed. The first portion 418 may be a first fluid reservoir and the second portion 420 may be a second fluid reservoir, where it is desired that fluid be removed from the first fluid reservoir and added to the second fluid reservoir. For examples where the mechanical system is a transmission, the first portion 418 may be a transmission sump, the second portion 420 may be a calm reservoir, and the fluid may be oil. The first portion 418 may fluidly couple to the chamber 137 via the first inlet port 120, the second inlet port 123, the first hole 153, and the second hole 157 when the first inlet port 120 and the second inlet port 123 are not covered by the piston 103. The second portion 420 may fluidly couple to the discharge compartment 136. In this way, the pressure regulating pump 200 may pump fluid from the first portion 418 to the second portion 420.

As the cam 162 rotates, the pressure regulating pump 200 may continue to oscillate between the positions according to rotation of the cam 162. The speed at which the piston 103 moves is related to the angular speed of cam 162 rotation which may be driven by an engine, an electric machine, an input shaft of a transmission, or the like. The pressure regulating pump 200 (and specifically the piston 103) may move back and forth between a TDC position and BDC position. However, there are factors which may cause pressure of the chamber 137 to increase beyond a threshold pressure when the first inlet port 120 and the second inlet port 123 are closed, including flow rate and temperature of the fluid. The factors which may increase pressure of the chamber 137 are described further below following a brief description of fluid across an orifice in regards to FIGS. 6A-6B, as well as equation (1) and equation (2) below.

$$Q = C_d \frac{\pi D_o^2}{4} \sqrt{\frac{2(p_1 - p_2)}{\rho}} \tag{1}$$

$$R_e = \frac{\rho v D}{\mu} \tag{2}$$

Equation (1) shows relationships between a pressure differential ($p_2$-$p_1$) across an orifice, a volumetric flow rate of a fluid (Q) flowing through the orifice, a density of the fluid (ρ), and a discharge coefficient ($C_d$) across the orifice. For example, the pressure differential ($p_2$-$p_1$) is directly related to the volumetric flow rate (Q) and the density of the fluid (ρ), and inversely related to the discharge coefficient ($C_d$). FIG. 6A shows a cross section view 600 of an example orifice 608 with a length 602 ($L_o$) and a diameter 607 ($D_o$), through which a fluid may flow from a first side 604 to a second side 606 in a direction indicated by arrow 609. As such, a first pressure ($p_1$) of the first side 604 may be greater than a second pressure ($p_2$) of the second side 606. As an example, the orifice 608 may represent the outlet port 122 of FIGS. 1A-5 such that the first side 604 may be the chamber 137 and the second side may be the discharge compartment 136. FIG. 6B displays a graph 610 showing discharge coefficient ($C_d$) (depicted along the y axis) plotted as a function of a ratio of the orifice diameter ($D_o$) and the orifice length ($L_o$) times the Reynolds number ($R_e$) of the fluid (depicted along the x axis). A curve 616 shows the discharge coefficient ($C_d$) for fluid flowing through an orifice, such as the orifice 608 shown in FIG. 6A or the outlet port 122 shown in FIGS. 1A-5. The discharge coefficient ($C_d$) increases along the y-axis of graph 610 in direction 612 and a ratio of the orifice diameter ($D_o$) and the orifice length ($L_o$) times the Reynolds number ($R_e$) of the fluid increases along the x-axis of graph 610 in direction 614. The Reynolds number ($R_e$) depends on velocity, viscosity, and density of the fluid as shown by equation (2), as well as geometry of a system in which the fluid flows. Thus, the discharge coefficient ($C_d$) is dependent on fluid properties (e.g., viscosity and density), fluid flow rate (e.g., volumetric flow rate), as well as the orifice geometry (e.g., orifice diameter and orifice length). For example, the discharge coefficient is directly related to the diameter of the orifice ($D_o$) and Reynolds number ($R_e$), and indirectly related to the length of the orifice ($L_o$), as shown by curve 616.

For example, returning to FIGS. 4A-4B, cam 162 rotating with high rotational speed may lead to a high volumetric flow of fluid through the outlet port 122 orifice, increasing the difference in pressure between the pressure of the chamber 137 and the pressure of the discharge compartment 136. Thus, the pressure of chamber 137 may exceed a desired pressure range during the portion of the exhaust stroke in which the first inlet port 120 and second inlet port 123 are closed, for example when the speed of the cam 162 is relatively high. Additionally or alternatively, a change in temperature of the fluid flowing through the pressure regulating pump 200 may affect the pressure build-up in the chamber 137. For example, a lower temperature of the fluid moving through the pressure regulating pump 200 may reduce the viscosity of the fluid and/or increase the density of the fluid. Because the pressure differential is inversely related to the Reynolds number, the pressure differential is directly related to the viscosity of the fluid and indirectly related to the density of the fluid; therefore, pressure of the chamber 137 may increase due to the lower temperature of the fluid.

Therefore, the pressure regulating pump 200 may include a pressure relief mechanism, including compression of the body spring 132 and downward movement of the body 100 in response to pressure of the chamber 137 meeting or exceeding a threshold pressure, to prevent pressure from exceeding the threshold pressure. To elaborate, the pressure regulating pump 200 may move to a pressure regulating position such that first inlet port 120 and second inlet port 123 may open when pressure of the chamber 137 is at least at the threshold pressure.

FIG. 5 shows the pressure regulating pump 200 in a pressure regulating position 500, wherein pressure of the chamber 137 has exceeded the threshold pressure in the exhaust stroke and as a result, the body spring 132 may be compressed and body 100 may be moved downwards compared to the positions of FIGS. 2-4B. In this way, pressure of the chamber 137 exceeding the threshold pressure may overcome a spring load of the body spring 132, causing the body spring 132 to be partially compressed and body 100 to be pushed downwards. The movement of the body 100 may occur relative to the casing 130 and axis of rotation 166 which may both remain in the same position. The sealing ring 135 may slide with the second groove 106 as the body 100 moves relative to the casing 130. To allow for relative movement of the body 100 downwards in the casing 130, a clearance C between an outer circumferential surface 502 of the body 100 and an inner circumferential surface 504 of the casing 130 may be between 0.1 mm and 0.3 mm. In some examples, the clearance C may be substantially equivalent (e.g., within 5%) to a clearance D between an outer surface of the wall 146 of the piston 103 and an inner cylindrical surface 149 of the outer cylindrical portion 144 of the body 100. The piston 103 may be in the same position as in BDC position 350 of FIG. 3 due to the cam 162 having the same angular position of approximately 180 degrees from the reference angular position. For example, the top 172 of the body 100 may be below the top 105 of the piston 103. Further, when in the pressure regulating position, the top 172 of the body 100 may be spaced away or offset from the one or more end stop devices 134. Thus, the body 100 moving downwards relative to the piston 103 may cause the first inlet port 120 and the second inlet port 123 to be lowered at least partially below the skirt edge 131 of the piston, thereby fluidly coupling the suction annulus 133 with the chamber 137, and reducing pressure of the chamber 137 to below the threshold pressure. Thus, the downward movement of the body 100 may increase a length of the inactive portion of the exhaust stroke and decrease a length of the active portion of the exhaust stroke. Consequently, a volumetric efficiency of the pressure regulating pump 200 may be decreased, and thus the volumetric flow rate of the fluid through the outlet port 122 may be decreased, thereby reducing the pressure of chamber 137 to below the threshold pressure. Additionally, in the pressure regulating position, the top of the inner cylindrical portion 142 may be lowered, and thus the volume of the chamber 137 may be increased, further contributing to a reduction in pressure of the chamber 137. As such, the pressure regulating pump 200 may self-regulate a displacement of the pressure regulating pump 200 in order to operate within the desired pressure range.

Therefore, the pressure regulating pump 200 may be able to regulate the pressure of the chamber 137, such that the pressure of the chamber 137 may be prevented from exceeding the threshold pressure without using any valves. More specifically, the ability of the body 100 to move depending on the pressure of the chamber 137 may allow the pressure regulating pump 200, which does not include any valves, to regulate pressure of the chamber 137 (e.g., to maintain the pressure of the chamber 137 at or below the threshold pressure). Thus, the pressure regulating pump 200 may be referred to as a valveless pressure regulating pump.

Turning to FIG. 7, a flowchart illustrating a method for operating a pressure regulating pump, such as pressure regulating pump 200, is shown. For example, the method 700 may be used to pump fluid through a pressure regulating pump. More specifically, the method 700 may be used to pump oil from a transmission sump to a clam reservoir via the pressure regulating pump 200.

At 702, a cam positioned to adjust a position of a piston of the pressure regulating pump is rotated. For example, cam 162 of the pressure regulating pump 200 as shown in FIGS. 2-5 may be rotated about axis of rotation 166 by a camshaft, which may be rotationally coupled to parts of the transmission. The cam may rotate with a constant rotational speed. Additionally or alternatively, the cam may rotate with varying rotational speed. For example, the cam may rotate at a first angular speed for a first amount of time, and in response to a change in transmission operation (e.g., a gear shift) the cam may rotate with a second rotational speed for a second amount of time. Rotation of the cam may cause pumping of fluid through the pressure regulating pump in subsequent steps.

At 703, fluid is pumped through the pressure regulating pump as the cam rotates. Pumping fluid through the pressure regulating pump may include performing an intake stroke (e.g., intake stroke 410 of FIG. 4B) to intake fluid via inlet ports of the pump, as indicated at 704. For example, fluid (e.g., oil and/or air) from a transmission sump may enter the pressure regulating pump 200 through the first inlet port 120 and the second inlet port 123. The cam may be rotated during the intake stroke such that cam lift is decreased, the piston is moved towards the axis of cam rotation, and the piston spring is expanded. Consequently, the inlet ports may be opened for fluid to flow into the pressure regulating pump therethrough.

Pumping fluid through the pressure regulating pump may further include performing an exhaust stroke (e.g., exhaust stroke 400 of FIG. 4A) to exhaust the fluid through an outlet port of the pump, as indicated at 706. For example, the fluid may be discharged from the pressure regulating pump 200 through the outlet port 122 into the discharge compartment, and then to a calm reservoir. The cam may be rotated during the exhaust stroke such that the cam lift is increased, the piston spring is compressed, and the piston is moved away from the axis of cam rotation. As a result, the inlet ports may be closed during the active portion of the exhaust stroke, and fluid may be forced out of the pressure regulating pump by a pressure difference across the outlet port.

At 708, pressure in the chamber of the pump is translated to axial movement of the pump body when pressure in the chamber exceeds a threshold pressure. For example, the body 100 of pressure regulating pump 200 may move away from the cam 162 due to compression of the body spring 132 in response to pressure of the chamber 137 meeting or exceeding the threshold pressure. Consequently, the length of the inactive portion of the exhaust stroke may be increased, thus reducing pressure back to below the threshold pressure. Once the pressure in the chamber is reduced to the threshold pressure or below, the body spring may urge (e.g., move) the body upwards, towards the cam.

Turning to FIG. 8A, a timeline diagram 800 is shown for operation of a pressure regulating pump, such as the pressure regulating pump 200 shown in FIGS. 1A-5, over a first period of time between t0 and t12. The timeline diagram 800 includes three example cycles of rotation of a cam, such as cam 162 which rotates about axis of rotation 166 as shown in FIGS. 2-5 during the first time period. As used herein, a cycle of rotation of the cam includes a full rotation from the reference angular position defined above, or rotation from 0 degrees to 360 degrees. The timeline diagram 800 shows a first plot 802 including a first curve 810 for a pressure of a chamber over time, a second plot 804 including a second curve 812 for an angular position of the eccentric, a third plot 806 including a third curve 814 for a vertical displacement of a piston, and a fourth plot 808 including a fourth curve 816 for a vertical displacement of a body. The first plot 802 includes a threshold pressure 811. The second plot 804 further includes a 0 degree reference line 826, a 180 degree reference line 824, and a 360 degree reference line 822. The third plot 806 further includes a TDC reference line 828 and a BDC reference line 830. The fourth plot 808 further includes a normal reference line 832 and a lowered reference line 834.

Axes of each plot (e.g., first plot 802, second plot 804, third plot 806, and fourth plot 808) may increase in the directions indicated by arrows of the axes. For example, time may increase horizontally along all four plots from t0 to t12 with intervals between the times marked. It is to be understood that time represents relative time such that t1 is some time after t0, t2 is some time after t1, and so on, but does not indicate specific or proportional quantities of time unless specified in the description below. Further, the timeline diagram 800 shows an example of various measurements during operation of a pressure regulating pump but does not limit the operation of pressure regulating pumps. For example, between t0 and t4, the third curve 814 showing vertical placement of piston is curved similar to a sinusoidal wave. However, with different cam shapes in different embodiments, this curve may appear differently. Similarly, the pressure of the chamber shown by the first curve 810 may behave differently (e.g., change faster or slower, change more or less) from the example shown in timeline diagram 800 depending on a variety of factors, including the cam shape and rotational speed, fluid properties and flow rate, and relative proportions of components of the pressure regulating pump. Thus, unless specified in the description below as specifically increasing or decreasing a certain amount or to a certain pressure, such as the threshold pressure 811, the first curve 810 does not restrict the dynamics of pressure in a pressure regulating pump.

In one example, briefly referring to FIGS. 1-5 in addition to FIG. 8A, if the pressure regulating pump being operated in timeline diagram 800 is pressure regulating pump 200, the pressure of the chamber shown in the first plot 802 may correspond to the pressure of chamber 137, the eccentric may be cam 162, the piston may be piston 103, and the body may be body 100. In the same example, the third curve 814 for the vertical placement of the piston may correspond to the position of piston 103 along the z-axis as indicated by reference axes 150; likewise, the fourth curve 816 for the vertical placement of the body may correspond to the position of body 100 along the z-axis. As such, the TDC position may be TDC position 250 of FIG. 2 and the BDC position may be BDC position 350 shown in FIG. 3. Additionally, the normal vertical placement of the fourth plot 808 may be the position of body 100 when in contact with end stop devices 134 while the lowered position may be the position of body 100 under maximum compression of body spring 132. The threshold pressure 811 may be the pressure at which the spring load of body spring 132 is overcome.

Returning to FIG. 8A and beginning with a first cycle occurring between t0 and t4, the eccentric starts at t0 at a 0-degree angular position (e.g., the reference angular position) which corresponds to a TDC position of the piston, and relatively low pressure. Between t0 and t1, the pressure regulating pump is in the inactive portion of a first exhaust stroke, as described with reference to FIG. 4A. At t1, the piston is lowered enough that inlet ports of the pressure regulating pump may be covered, thus pressure of the chamber begins to build during the active portion of the exhaust stroke between t1 and t2.

Between t1 and t2, the pressure regulating pump is in the active portion of the first exhaust stroke such that the chamber is closed from fluid entering by the inlet ports being covered by the piston. The pressure build-up (e.g., due to a decrease in volume of the chamber) as seen by the increase in the first curve 810 may drive fluid from the chamber to the discharge compartment, thus pushing fluid out of the pump through the outlet port. For example, oil may flow from the chamber to the discharge compartment and subsequently to a calm reservoir.

Between t2 and t4, the pressure regulating pump is in a first intake stroke. At t3, the inlet ports are opened, restoring the fluidic coupling between the chamber and the exterior of the pump via one or more holes in the casing (e.g., the first hole 153 and the second hole 157 of FIGS. 2-5) and the inlet ports. Thus, the piston moves upwards back towards the TDC marked by the TDC reference line 828 and the pressure is reduced in the chamber as suction builds. During the intake stroke, the reduction in pressure drives fluid flow from outside the pressure regulating pump to inside the pressure regulating pump, more specifically into the chamber of the pressure regulating pump, via the inlet ports and holes. For example, oil may flow into the chamber of the pressure regulating pump from a transmission sump via one or more inlet ports and one or more holes.

The pressure does not reach the threshold pressure 811 at any point in time between t0 and t4 as shown by the first curve 810. Therefore, the body remains in the normal vertical placement marked by normal reference line 832 during the first cycle, while the piston moves vertically according to cam rotation, causing fluctuations in pressure shown by first curve 810 between t4 and t5. For example, the piston is at the TDC position when the angular position is 0 degrees, or when the second curve 812 connects with the reference line 826 or the reference line 822, and the piston is at the BDC position when the angular position is 180 degrees, or when the second curve 812 intersects the reference line 824. Additionally, between t0 and t4 the pressure of the chamber decreases during the corresponding intake stroke (e.g., transition from BDC to TDC), and decreases during the active portion of the intake stroke (e.g., a portion of the transition from TDC to BDC). At t4, the first cycle ends with the piston returned back to the TDC position and the cam angular position back at the reference angular position as shown in the third plot 806 and the second plot 804, respectively.

A second cycle occurs between t4 and t8, with a second exhaust stroke between t4 and t6 and a second intake stroke between t6 and t8. The second cycle may be over a shorter period of time than the first cycle. That is, the time between t4 and t8 may be less than the time between t0 and t4. At t5, the inlet ports are closed, causing an increase in pressure during the active portion of the second exhaust stroke between t5 and t6 as seen by the first curve 810. Further, the pressure of the chamber reaches the threshold pressure 811 between t5 and t6. For example, during the second cycle, the cam rotational speed may be higher and/or the temperature of the fluid may be lower than during the first cycle in which the threshold pressure was not reached, thus resulting in a higher pressure in the chamber that reaches the threshold pressure. As such, the body is moved downwards towards the lowered position marked by the lowered reference line 834 between t5 and t6 to extend the active portion of the second exhaust stroke and thereby reduce the pressure of the chamber to below the threshold pressure 811. As described with reference to FIG. 5, the movement of the body may be initiated by compression of the body spring in response to pressure shown by the first curve 810 exceeding the threshold pressure 811. Between t5 and t6, the body is also raised back to the normal position marked by normal reference line 832 as the pressure of the chamber shown by the first curve 810 is reduced to below the threshold pressure 811. When the angular positon of the cam shown by the second curve 812 exceeds 180 degrees or crosses the 180 degree reference line 824 at t6, the pressure regulating pump transitions from the second exhaust stroke to the second intake stroke such that the pressure of the chamber shown by the first curve 810 continues to decrease thereafter.

A third cycle occurs between t8 and t12, including a third exhaust stroke between t8 and t10 and a third intake stroke between t10 and t12. The third cycle may be shorter than the second cycle. For example, the time between t8 and t12 may be less than the time between t4 and t8. The angular position of the cam and the vertical placement of the piston follow similar paths as to the second cycle between t4 and t8, although over a relatively smaller amount of time, while the pressure and the vertical displacement of the body change differently. As such, it is shown that the pressure may not follow the same pattern between cycles wherein the pressure reaches the threshold due to factors which affect chamber pressure. For example, the cam may rotate with greater rotational speed between t8 and t12 than between t4 and t8. Additionally or alternatively, the temperature of the fluid being pumped by the pressure regulating pump may be lower between t8 and t12 than between t4 and t8.

Operating conditions that affect the pressure build-up in the chamber (e.g., cam rotational speed and temperature of fluid being pumped) may be different between cycles. Consequently, whether the pressure regulating pump moves to the pressure regulating position to prevent exceeding the threshold pressure may be dependent on the operating conditions, in at least some examples. For example, the cam rotational speeds during the second cycle and the third cycle may be higher than the cam rotational speed during the first cycle. Additionally or alternatively, the temperature of the fluid being pumped may be lower during the second cycle and the third cycle than during the first cycle. As a result, the threshold pressure was met in the second and third cycles, but not the first cycle. Thus, the pressure in the chamber may reach the threshold pressure during some cycles, and the pressure regulating pump may move to the pressure regulating position in response.

Turning to FIG. 8B, the timeline diagram 800 is shown over a second time period from t20 to t27 which may occur before or after t0 to t12 as shown in FIG. 8A. Further, there may be time intervals between the periods shown in FIG. 8A (e.g., the first time period from t0 to t12) and FIG. 8B (e.g., the second time period between t20 and t27). The timeline diagram 800 includes plots, curves, and lines as shown in FIG. 8A which are labeled accordingly. The timeline diagram 800 further shows a O/C reference line 829 on the third plot 806 in FIG. 8B indicating piston vertical placement where the inlet ports are opened or closed.

A fourth cycle occurs between t20 and t27, with a fourth exhaust stroke between t20 and t24 and a fourth intake stroke between t25 and t27. The fourth cycle begins at t20 with the piston at a TDC position, the body in a normal vertical placement, and the cam at the reference angular position. Between t20 and t21, the pressure regulating pump is in an inactive portion of the fourth exhaust stroke. At t21, the inlet ports are closed as shown by the third curve 814 intersecting the O/C reference line 829 and moving towards the BDC reference line 830. Thus, the pressure begins increasing at t21, and reaches the threshold pressure 811 at t22. In response, at t22, the body begins to move downwards to increase volume in the chamber, therefore preventing further increase of pressure in the chamber. The body returns to normal vertical placement at t23, and pressure begins to decrease. Then at t24, the piston reaches the BDC position as the cam reaches a 180 degree angular position. In other examples where the threshold pressure is reached, the piston BDC position may be reached before the body returns to the normal placement and pressure is reduced.

The timeline diagram 800 shows a larger space between t24 and t25 than may be proportional to other time intervals to more clearly illustrate the timing and causation of pressure reduction. The pressure of the chamber may be further reduced, even following the return of the body to the normal vertical placement, while at the BDC position due to fluid flowing out of the chamber through the one or more outlet ports. At t25, the fourth intake stroke begins, thus causing a further decrease in pressure as the volume of the chamber is increased, followed by an increase in pressure after t26 as fluid flows into the chamber due to the inlet ports being opened at t26.

As shown in timeline diagram 800 in FIGS. 8A and 8B, the pressure regulating pump maintains pressure of the chamber at or below the threshold pressure 811. Thus, the pressure regulating pump may self-regulate pressure of the chamber by adjusting the displacement of the pressure regulating pump without the use of any valves (e.g., pressure regulating valves, pressure relief valves, counterbalance valves, and the like). In other words, the pressure of the chamber may be translated to axial movement of the body to maintain the pressure at or below the threshold pressure (e.g., threshold pressure 811).

The technical effect of the pressure regulating pump disclosed herein is to pump fluid through the pressure regulating pump and maintain a pressure of a chamber within the pressure regulating pump at or below a threshold pressure without using valves. Thus, the pressure regulating pump may reduce complexity compared to a pump which is used in combination with valves for pressure regulation. Further, the pressure regulating pump may be mechanically actuated such that the pressure regulating pump may be accommodated within a transmission housing. Further still, the pressure regulating pump may be appropriate for pumping oil from a transmission sump to a calm reservoir due to the adequate displacement, and ability to accommodate two-phase flow. Thus, the pressure regulating pump may reduce complexity of the system in which the pressure regulating pump is incorporated, such as a transmission, and reduce resource demand compared to other pumps due to eliminating use of valves.

The disclosure also provides support for a pump, comprising: a casing, a pump body accommodated within the casing, the pump body comprising an outer cylindrical portion and an inner cylindrical portion, wherein the outer cylindrical portion includes one or more inlet ports and the inner cylindrical portion includes one or more outlet ports, a piston interposed between the outer cylindrical portion and the inner cylindrical portion and configured to move axially relative to the one or more inlet ports, the piston and a top of the inner cylindrical portion defining a chamber, a first spring at least partially interposed between the piston and the inner cylindrical portion, and a second spring interposed between the casing and a bottom of the pump body, wherein the pump body is configured to move axially relative to the casing and compress the second spring when a pressure in the chamber exceeds a pre-load of the second spring. In a first example of the system, the inner cylindrical portion is housed within the outer cylindrical portion and spaced apart from the outer cylindrical portion by a cylindrical cavity, and wherein the cylindrical cavity is in fluid communication with the chamber. In a second example of the system, optionally including the first example, the inner cylindrical portion has a hollow interior defining a discharge compartment, and wherein the discharge compartment is fluidly coupled to the chamber via the outlet port. In a third example of the system, optionally including one or both of the first and second examples, the one or more inlet ports are configured to be fluid communication with the cylindrical cavity. In a fourth example of the system, optionally including one or more or each of the first through third examples, the piston is movable between a top dead center (TDC) position and a bottom dead center (BDC) position, wherein at the TDC position, the one or more inlet ports are at least partially uncovered to provide fluid communication between the one or more inlet ports and the cylindrical cavity, and wherein at the BDC position, the one or more inlet ports are covered by the piston and fluid communication between the one or more inlet ports and the cylindrical cavity is blocked. In a fifth example of the system, optionally including one or more or each of the first through fourth examples, the second spring comprises one or more cup springs arranged in series. In a sixth example of the system, optionally including one or more or each of the first through fifth examples, the system further comprises: one or more end stop devices coupled to the casing and configured to stop upward movement of the pump body. In a seventh example of the system, optionally including one or more or each of the first through sixth examples, the pump is housed in a transmission, wherein the one or more inlet ports are fluidly coupled to a sump of the transmission, and wherein the outlet port is fluidly coupled to a calm reservoir of the transmission. In an eighth example of the system, optionally including one or more or each of the first through seventh examples, the pump is configured to move axially via rotation of a cam coupled to a shaft. In a ninth example of the system, optionally including one or more or each of the first through eighth examples, the pump does not include any valves.

The disclosure also provides support for a method for a pressure regulating pump, comprising: maintaining a pressure of a pump chamber of the pressure regulating pump at or below a threshold pressure by translating the pressure of the pump chamber to axial movement of a pump body of the pressure regulating pump, the pump body including a cylindrical cavity housing a spring-loaded piston and configured to fluidly couple one or more inlet ports of the pump body to an outlet port. In a first example of the method, the method further comprises: pumping a fluid with the pressure regulating pump, the pumping including intaking the fluid to the pump chamber via the one or more inlet ports during an intake stroke of the piston and exhausting the fluid from the pump chamber via the outlet port during an exhaust stroke of the piston. In a second example of the method, optionally including the first example, the pump body is housed in a casing with a body spring coupled between the pump body and the casing, and wherein maintaining the pressure of the pump chamber at or below the threshold pressure by translating the pressure of the pump chamber to axial movement of the pump body comprises, when the pressure of the pump chamber exceeds a pre-load of the body spring, axially moving the pump body via the pressure in the pump chamber. In a third example of the method, optionally including one or both of the first and second examples, the moving of the pump body moves the one or more inlet ports relative to the piston. In a fourth example of the method, optionally including one or more or each of the first through third examples, the method further comprises: moving the piston during the exhaust stroke via rotation of a cam on a camshaft.

The disclosure also provides support for a valveless pressure regulating pump, comprising: a pump body including one or more inlet ports and an outlet port, a spring-loaded piston at least partially accommodated within the pump body and configured to pump fluid into and out of a pump chamber formed between the piston and the pump body, and a casing housing the piston and the pump body, wherein the pump body is configured to move axially relative to the casing. In a first example of the system, the pump body is configured to move vertically downward when a pressure of the pump chamber exceeds a pre-load of a spring coupled between the pump body and the casing. In a second example of the system, optionally including the first example, the pump chamber is fluidly coupled to a discharge compartment via the outlet port and is fluidly coupled to a fluid supply via the one or more inlet ports. In a third example of the system, optionally including one or both of the first and second examples, the piston is movable between a top dead center (TDC) position and a bottom dead center (BDC) position, wherein at the BDC position, the one or more inlet ports are covered by the piston and fluid communication between the fluid supply and the pump chamber is blocked, and wherein at the TDC position, the one or more inlet ports are at least partially uncovered to provide fluid communication between the fluid supply and the pump chamber. In a fourth example of the system, optionally including one or more or each of the first through third examples, the pump body is cylindrical and the casing is cylindrical, and wherein the one or more inlet ports are positioned in an annular recess of the pump body, the annular recess and the casing collectively defining a suction annulus.

FIGS. 1A-5 show example configurations with relative positioning of the various components. FIGS. 1A-3 and 5 are shown approximately to scale; though other relative dimensions may be used. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Additionally, elements co-axial with one another may be referred to as such, in one example. Further, elements shown intersecting one another may be referred to as intersecting elements or intersecting one another, in at least one example. Further still, an element shown within another element or shown outside of another element may be referred as such, in one example. In other examples, elements offset from one another may be referred to as such.

Features described as axial may be approximately parallel with an axis referenced unless otherwise specified. As used herein, the terms "approximately" is construed to mean plus or minus five percent of the range unless otherwise specified. Features described as counter-axial may be approximately perpendicular to the axis referenced unless otherwise specified. Features described as radial may circumferentially surround or extend outward from an axis, such as the axis referenced, or a component or feature described prior as being radial to a referenced axis, unless otherwise specified.

Features described as longitudinal may be approximately parallel with an axis that is longitudinal. A lateral axis may be normal to a longitudinal axis. Features described as lateral may be approximately parallel with the lateral axis. A vertical axis may be normal to a lateral axis and a longitudinal axis. Features described as vertical may be approximately parallel with a vertical axis.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A pump, comprising:

a casing;

a pump body accommodated within the casing, the pump body comprising an outer cylindrical portion and an inner cylindrical portion, wherein the outer cylindrical portion includes one or more inlet ports and the inner cylindrical portion includes one or more outlet ports;

a piston interposed between the outer cylindrical portion and the inner cylindrical portion and configured to move axially relative to the one or more inlet ports, the piston and a top of the inner cylindrical portion defining a chamber;

a first spring at least partially interposed between the piston and the inner cylindrical portion; and a second spring interposed between the casing and a bottom of the pump body, wherein the outer cylindrical portion and the inner cylindrical portion are configured to move axially relative to the casing and compress the second spring when a pressure in the chamber exceeds a pre-load of the second spring.

2. The pump of claim 1, wherein the inner cylindrical portion is housed within the outer cylindrical portion and spaced apart from the outer cylindrical portion by a cylindrical cavity, and wherein the cylindrical cavity is in fluid communication with the chamber, and wherein the first spring and the piston are positioned between the outer cylindrical portion and the inner cylindrical portion in the cylindrical cavity with the outer cylindrical portion circumferentially surrounding at least part of the piston, the piston circumferentially surrounding at least part of the first spring, and the first spring circumferentially surrounding the inner cylindrical portion.

3. The pump of claim 2, wherein the inner cylindrical portion has a hollow interior defining a discharge compartment, and wherein the discharge compartment is fluidly coupled to the chamber via the one or more outlet ports.

4. The pump of claim 2, wherein the one or more inlet ports are configured to be in fluid communication with the cylindrical cavity.

5. The pump of claim 4, wherein the piston is movable between a top dead center (TDC) position and a bottom dead center (BDC) position, wherein at the TDC position, the one or more inlet ports are at least partially uncovered to provide fluid communication between the one or more inlet ports and the cylindrical cavity, and wherein at the BDC position, the one or more inlet ports are covered by the piston and fluid communication between the one or more inlet ports and the cylindrical cavity is blocked.

6. The pump of claim 1, wherein the second spring comprises a plurality of cup springs arranged in series.

7. The pump of claim 1, further comprising one or more end stop devices coupled to the casing and configured to stop upward movement of the pump body.

8. The pump of claim 1, wherein the pump is housed in a transmission, wherein the one or more inlet ports are fluidly coupled to a sump of the transmission, and wherein the outlet port is fluidly coupled to a reservoir of the transmission.

9. The pump of claim 1, wherein the piston is configured to move axially via rotation of a cam coupled to a shaft.

10. The pump of claim 1, wherein the pump does not include an additional pressure relief valve.

11. A method for a pressure regulating pump, comprising:

maintaining a pressure of a pump chamber of the pressure regulating pump at or below a threshold pressure by translating the pressure of the pump chamber to axial movement of a pump body of the pressure regulating pump, the pump body including a cylindrical cavity housing a spring-loaded piston and configured to fluidly couple one or more inlet ports of the pump body to an outlet port, the axial movement of the pump body moving the one or more inlet ports relative to the piston;

wherein the outlet port is positioned vertically higher than the one or more inlet ports, the outlet port at and extending through a top center of an inner cylindrical portion of the pump body positioned inside a spring of the spring-loaded piston, the inner cylindrical portion having a hollow center forming a discharge compartment fluidly coupled to the cylindrical cavity via the outlet port.

12. The method of claim 11, further comprising pumping a fluid with the pressure regulating pump, the pumping including intaking the fluid to the pump chamber via the one or more inlet ports during an intake stroke of the piston and exhausting the fluid from the pump chamber into the discharge compartment via the outlet port during an exhaust stroke of the piston.

13. The method of claim 12, wherein the pump body is housed in a casing with a body spring coupled between the pump body and the casing, and wherein maintaining the pressure of the pump chamber at or below the threshold pressure by translating the pressure of the pump chamber to axial movement of the pump body comprises, when the pressure of the pump chamber exceeds a pre-load of the body spring, axially moving the pump body via the pressure in the pump chamber.

14. The method of claim 13, further comprising moving the piston during the exhaust stroke via rotation of a cam on a camshaft.

15. The method of claim 11, wherein the one or more inlet ports have a curved, chamfered edge that allows fluid to flow into the pump body without passing a sharp corner.

16. A pressure regulating pump, comprising:

a pump body comprising an outer cylindrical portion and an inner cylindrical portion accommodated within the outer cylindrical portion, wherein the outer cylindrical portion includes one or more inlet ports and the inner cylindrical portion includes an outlet port;

a spring-loaded piston at least partially accommodated within the pump body and between the outer cylindrical portion and the inner cylindrical portion and configured to pump fluid into and out of a pump chamber formed between the piston and the inner cylindrical portion; and a casing housing the piston and the pump body, wherein the outer cylindrical portion and the inner cylindrical portion are configured to move axially relative to the casing.

17. The pump of claim 16, wherein the pump body, including the outer cylindrical portion and the inner cylindrical portion, is configured to move vertically downward when a pressure of the pump chamber exceeds a pre-load of a spring coupled between the pump body and the casing.

18. The pump of claim 16, wherein the pump chamber is fluidly coupled to a discharge compartment via the outlet port and is fluidly coupled to a fluid supply via the one or more inlet ports.

19. The pump of claim 18, wherein the piston is movable between a top dead center (TDC) position and a bottom dead center (BDC) position, wherein at the BDC position, the one or more inlet ports are covered by the piston and fluid communication between the fluid supply and the pump chamber is blocked, and wherein at the TDC position, the one or more inlet ports are at least partially uncovered to provide fluid communication between the fluid supply and the pump chamber.

20. The pump of claim 16, wherein the casing is cylindrical, and wherein the one or more inlet ports are positioned in an annular recess of the outer cylindrical portion, the annular recess and the casing collectively defining a suction annulus.

* * * * *